US008784087B2

(12) United States Patent
Hirano et al.

(10) Patent No.: US 8,784,087 B2
(45) Date of Patent: Jul. 22, 2014

(54) ROOTS TYPE FLUID MACHINE

(75) Inventors: Takayuki Hirano, Aichi-ken (JP); Kazuho Yamada, Aichi-ken (JP); Masato Sowa, Kariya (JP); Toshiro Fujii, Kariya (JP); Tsutomu Nasuda, Kariya (JP); Katsutoshi Shiromaru, Kariya (JP); Fumihiro Suzuki, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 880 days.

(21) Appl. No.: 12/751,719

(22) Filed: Mar. 31, 2010

(65) Prior Publication Data

US 2010/0254846 A1 Oct. 7, 2010

(30) Foreign Application Priority Data

Apr. 1, 2009 (JP) ..... P2009-089127

(51) Int. Cl.
*F01C 1/18* (2006.01)
*F03C 2/00* (2006.01)

(52) U.S. Cl.
USPC ..... 418/206.5; 418/206.1; 418/150

(58) Field of Classification Search
USPC ..... 418/150, 206.1–206.9
See application file for complete search history.

(56) References Cited

U.S. PATENT DOCUMENTS

| | | | | |
|---|---|---|---|---|
| 4,666,385 | A | 5/1987 | Okamoto et al. | |
| 7,320,579 | B2 * | 1/2008 | Hirano et al. | 418/150 |
| 7,491,041 | B2 * | 2/2009 | Imai et al. | 418/9 |
| 2007/0048162 | A1 * | 3/2007 | Imai et al. | 418/9 |
| 2007/0148030 | A1 * | 6/2007 | Hirano et al. | 418/206.1 |
| 2008/0181803 | A1 | 7/2008 | Weinbrecht | |

FOREIGN PATENT DOCUMENTS

| | | |
|---|---|---|
| JP | 60/147790 | 10/1985 |
| JP | 2007-162476 | 6/2007 |
| WO | WO 89/04924 | 6/1989 |

* cited by examiner

*Primary Examiner* — Hoang Nguyen
(74) *Attorney, Agent, or Firm* — Baker & Hostetler LLP

(57) ABSTRACT

A roots type fluid machine includes suction and discharge ports, rotary shafts and a pair of rotors. The rotor has a number n of lobe and valley portions with apex and bottom ends. The lobe portions are located on imaginary lines extending radially from an axis of the rotary shaft. The outer surface of each one of the rotors is generated by rotating an outline of the rotor including an arc and involute and envelope curves around and moving the outline in the direction of the axis. The arc has a radius R and a center located on the imaginary line. The involute curve is formed by an imaginary base circle having a radius r and a center located on the axis. The envelope curve is formed by an arc having a radius R. The number n is four or more. A torsional angle β is over 360/n degrees.

5 Claims, 14 Drawing Sheets

ROOTS TYPE FLUID MACHINE

CROSS-REFERENCE TO RELATED APPLICATIONS

This application claims priority to Japanese Application No. 2009-089127 filed Apr. 1, 2009.

BACKGROUND

The present invention relates to a roots type fluid machine.

A roots type fluid machine is known which includes a housing, a pair of rotary shafts, a pair of rotors and a rotor chamber. The housing has a suction port and a discharge port formed therein, and the paired rotary shafts are rotatably arranged in parallel to each other in the rotor chamber. The rotors respectively including lobe and valley portions are rotatably mounted on the respective rotary shafts and engaged with each other in the rotor chamber. Fluid chambers are formed between the rotors and the inner surface of the rotor chamber. During the rotation of the rotors, the fluid chamber firstly communicates with the suction port, then is closed from the suction and discharge ports, and communicates with the discharge port. The volume of the fluid chamber is gradually increased while the fluid chamber is in communication with the suction port, and gradually decreased while the fluid chamber is closed or in communication with the discharge port, thus performing a pumping operation. That is, fluid is flowed in through the suction port, then compressed and discharged out through the discharge port.

FIG. 13 shows a conventional roots type fluid machine. Referring to the drawing, a rotor chamber 73 has an inner peripheral surface whose transverse section is formed by connecting two circles 71, 72 centered on axes O1, O2, respectively, and the angle formed between a line L1 connecting the axes O1, O2 and a line L2 connecting the axis O1 and an intersecting point (cusp) S or D of the two circles 71, 72 is X degree.

As shown in FIG. 13, the rotors 98, 99 are plane symmetrical to each other and, therefore, only one of the rotors, i.e. the rotor 98, will be explained (the same is applicable to the rest of the description). The rotor 98 is defined by the axis O1 of the rotary shaft 91, a plurality of imaginary lines Li, curved outlines Le and outer surfaces F. The imaginary lines Li extend radially from the axis O1 toward the respective apex ends T of the rotor 98 and are spaced angularly at a substantially equal angle. The number of the imaginary lines Li equals to the number n of lobe portions or valley portions of the rotor 98. The curved outline Le connects the bottom end B of the valley portion 93 and the apex end T of the lobe portion 92. The outer surface F is formed by the outline Le rotated and moved in the direction of the axis O1 for a distance corresponding to the axial length of the rotor 98. If the outline Le of the rotor 98 is formed by an involute curve, the rotor 98 collides with the rotor 99 at the top end of the lobe portion of the rotor 99. In order to forestall such collision, the outline Le of the rotor 98 is formed with an undercut so as to reduce the dead volume formed in the roots type fluid machine. Thus, in a general conventional roots type fluid machine, the outline Le is formed by an involute curve and an envelope curve which is described by the path of the top end of the lobe portion of the mating rotor. The rotor of the conventional roots type fluid machine shown in FIG. 13 is of a six-lobe configuration in which the value of n is six and each number of the lobe and valley portions is six.

In the conventional roots type fluid machine wherein the shape of the lobe portion 92 of the rotor 98 is narrowed toward the apex end T thereof, the moment of inertia of the rotor 98 is relatively small and, therefore, the rotor 98 may be driven easily to rotate at a high speed. The space for the rotor 98 in the rotor chamber 73 may be reduced, so that the volume of the fluid chamber 96 may be increased and the displacement by the rotor 98 may be increased for a small size of the roots type fluid machine.

However, in this conventional roots type fluid machine shown in FIG. 13, a large dead volume 30 is formed between the rotors 98, 99, so that power loss due to fluid leakage is relatively large and the noise tends to be generated by reexpansion of fluid.

For this reason, a roots type fluid machine has been disclosed in Japanese Patent Application Publication No. 2007-162476 by the present applicant. As shown in FIG. 14, the rotor 88 of the roots type fluid machine disclosed in the above Publication is of two-lobe or three-lobe configuration in which the value of n is two or three and each number of the lobe and valley portions is two or three. In the roots type fluid machine of the above Publication, the outline Le of the rotor 88 is formed by an arc 81A, an involute curve 82A and an envelope curve 83.

As shown in FIG. 14, the arc 81A, which forms a part of a circle 81 having its center at Q1 located on an imaginary line Li passing through the apex end T of the lobe portion and a radius R, extends from the apex end T to a first transition point C1 between the arc 81A and the involute curve 82B of the outline Le. Reference symbol R1 indicates the distance between the axis O1 of the rotor 88 and the center Q1 of the circle 81. The involute curve 82A, which is based on the circle 82 having its center Q2 located at the axis O1 and a radius r, extends from the first transition point C1 to a second transition point C2 connected to the envelop curve 83 of the outline Le. The involute curve 82A is formed continuously with the arc 81A. The envelope curve 83 extends from the second transition point C2 to the bottom end B of the outline Le and along outside of a path of the arc 81A of the lobe portion of the mating rotor 89. The envelope curve 83 is formed continuously with the involute curve 82A. According to the roots type fluid machine disclosed in Japanese Patent Application Publication No. 2007-162476, power loss and noise development may be reduced and stable volumetric efficiency may be obtained.

Therefore, the present invention is directed to providing a roots type fluid machine according to which power loss and noise development may be further reduced and stable volumetric efficiency $\eta V$ and a reliable and excellent overall thermal efficiency $\eta tad$ may be achieved.

SUMMARY

In accordance with the present invention, a roots type fluid machine includes a housing, a rotor chamber, a suction port, a discharge port, a pair of rotary shafts, a pair of rotors and a fluid chamber. The rotor chamber is formed by the housing. The suction and the discharge ports are formed in the housing. The rotary shafts are rotatably arranged in parallel to each other in the rotor chamber. A pair of the rotors respectively has a number n of lobe portions with an apex end and valley portions with a bottom end for engaging each other and is fixed on each rotary shaft for rotation therewith in the rotor chamber. The lobe portions of the rotor are located on imaginary lines extending radially from an axis of the rotary shaft at an angularly spaced apart, respectively. The fluid chamber is defined by the outer surfaces of the rotors and the inner surface of the rotor chamber. Fluid is flowed in through the suction port and discharged out through the discharge port by rotating the rotors in the fluid chamber. The outer surface of the rotor is defined by an outline of the rotor being rotated and moved in the direction of the axis of the rotary shaft. The outline of the rotor extends from each apex end of the lobe portion to the bottom end of the valley portion through a first transition point and a second transition point thereon. The outline of the rotor includes an arc, an involute curve and an envelope curve. The arc extends from the apex end of the lobe portion to the first transition point and having a radius R and a center located on the imaginary line. The involute curve extends continuously from the first transition point to the second transition point and formed by an imaginary base circle having a radius r and a center located at the axis of the rotary shaft. The envelope curve with an arc having a radius R extends continuously from the second transition point to the bottom end of the valley portion. The number n of the lobe portions is four or more. A torsional angle β of the lobe portions is over 360/n degrees.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF ILLUSTRATIVE EMBODIMENTS

The following will describe a roots type fluid machine embodied in a roots type compressor according to a first preferred embodiment of the present invention with reference to FIGS. 1 through 12.

Figure 1:
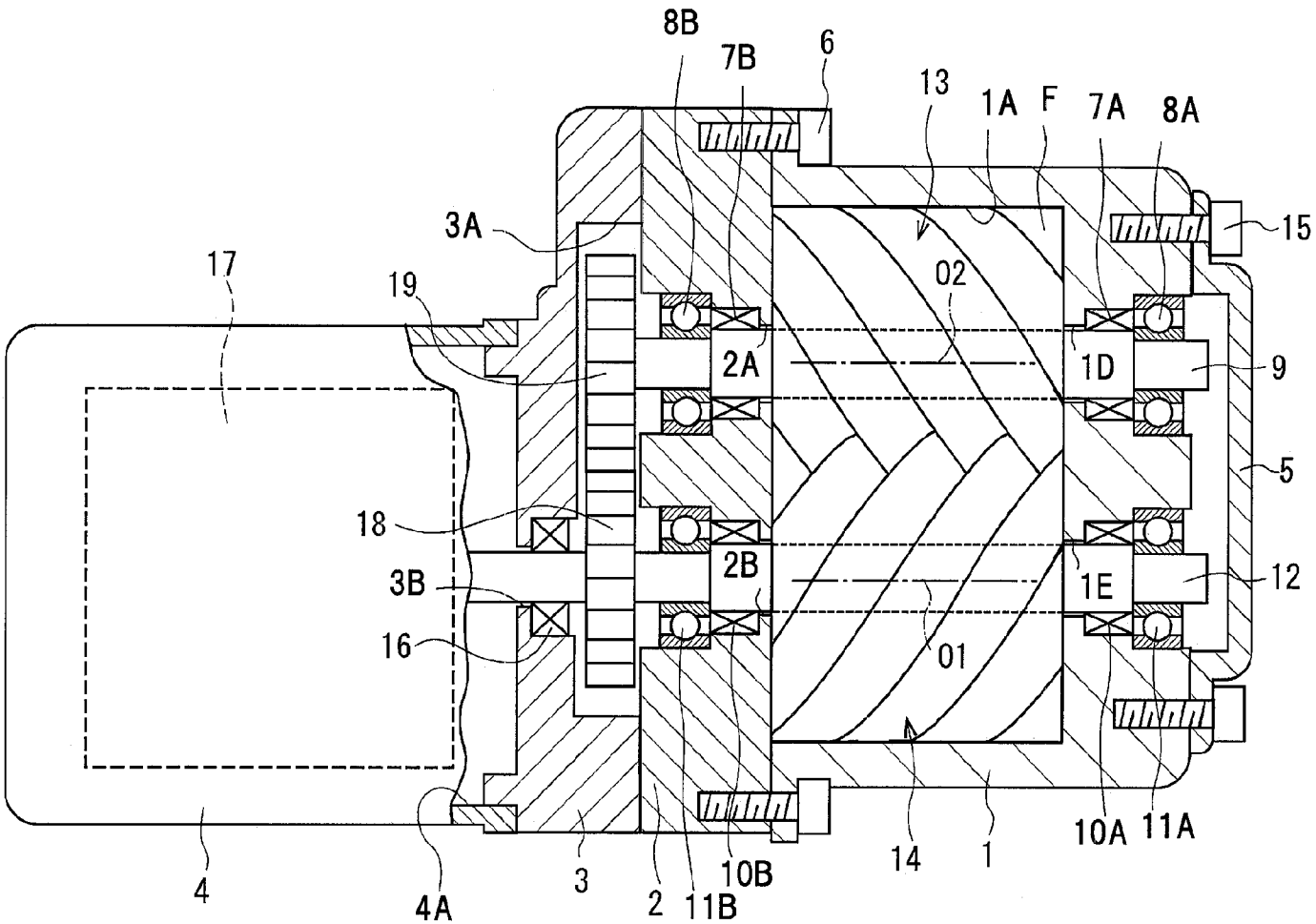
FIG. 1 is a longitudinal sectional view of a roots type compressor according to a preferred embodiment of the present invention.

Referring to FIG. 1, the roots type compressor includes a rotor housing 1, an end plate 2, a gear housing 3, a motor housing 4 and an end cover 5 which form a housing.

Figure 2:
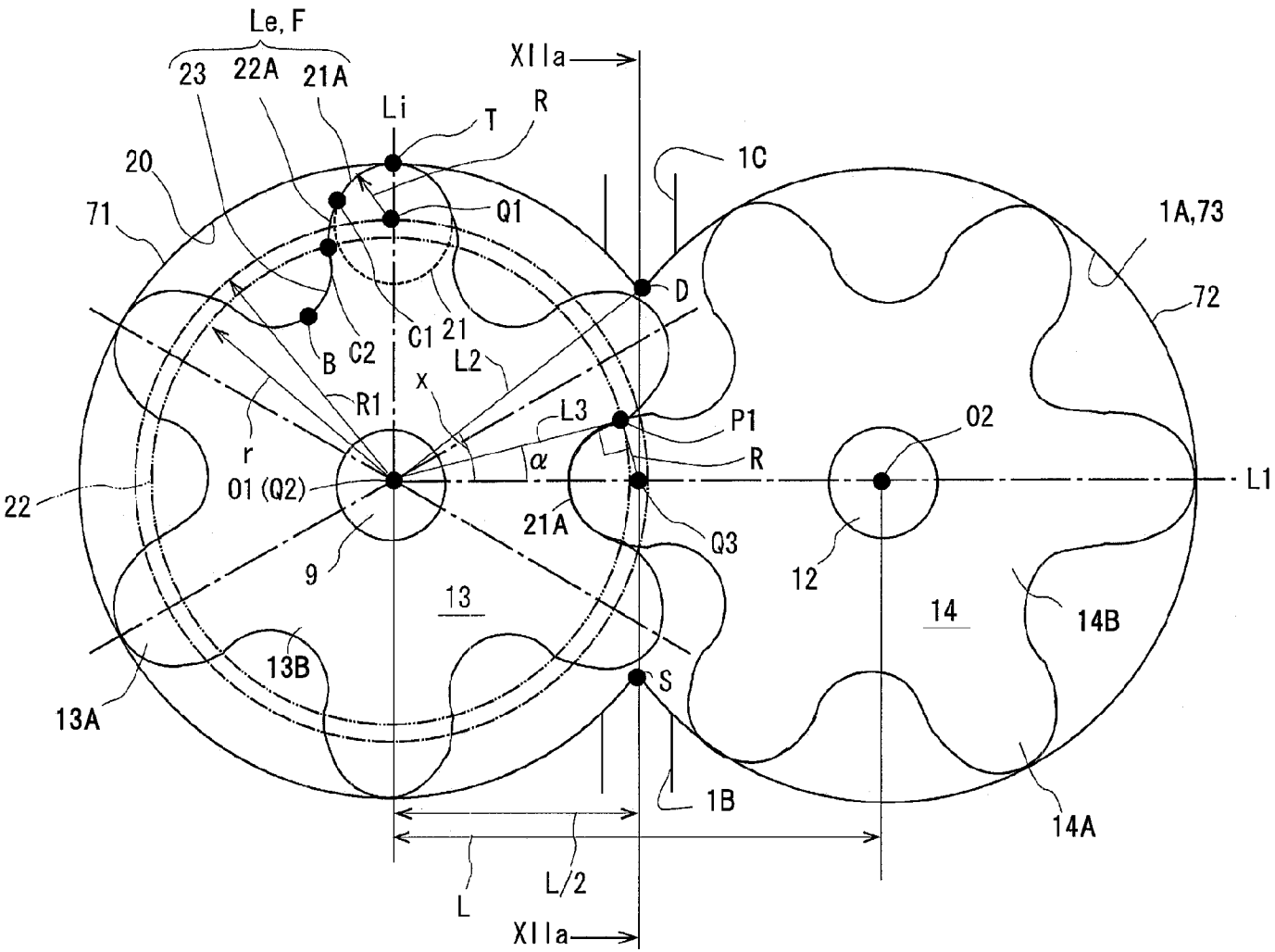
FIG. 2 is a schematic view taken perpendicular to the axes of two rotors of the roots type compressor of FIG. 1, showing a section of a housing and the two rotors.

The end plate 2 is fixed to the rotor housing 1 by means of a plurality of bolts 6. A rotor chamber 1A of a cocoon shape (FIG. 2) is formed by the rotor housing 1 and the end plate 2. Referring to FIG. 2, the rotor chamber 1A has an inner surface whose transverse section is formed by connecting two circles 71, 72 centered on axes O1, O2, respectively. An angle X formed between a line L1 connecting the axis O1 and the axis O2 and a line L2 connecting the axis O1 and an intersection point (cusp) S or D between the two circles 71, 72 is 50 degrees. This angle X of 50 degrees is common in many roots type compressors.

A suction port 1B and a discharge port 1C are formed in the rotor housing 1. As shown in FIG. 2, the suction port 1B is opened at the intersection point S and located at a position on the far side in FIG. 1 as seen from the viewer's side, and the discharge port 1C is opened at the intersection point D and located at a position on the near side of FIG. 1.

As shown in FIG. 1, two pairs of holes 1D, 1E and 2A, 2B are formed in the rotor housing 1 and the end plate 2, respectively. A rotary shaft 9 is mounted at the opposite end thereof in the holes 1D, 2A and rotatably supported by shaft seals 7A, 7B and bearings 8A, 8B. Similarly, a rotary shaft 12 is mounted in the holes 1E, 2B and rotatably supported by shaft seals 10A, 10B and bearings 11A, 11B. The rotary shafts 9, 12 are disposed in parallel such that the axis O1 of the rotary shaft 9 and the axis O2 of the rotary shaft 12 are spaced away from each other at a distance L, as shown in FIG. 2.

In the rotor chamber 1A, a rotor 13 is fixed on the rotary shaft 9 for rotation therewith and, a rotor 14 is fixed on the rotary shaft 12 for rotation therewith. The rotor 13 includes a lobe portion 13A and a valley portion 13B, and the rotor 14 includes a lobe portion 14A and a valley portion 14B. The lobe portions 13A, 14A are engaged with their mating valley portions 14B, 13B, respectively. The roots type compressor is a six-lobe configuration in which each lobe number n of the rotors 13, 14 is six and each number of the lobe portions 13A, 14A and the valley portions 13B, 14B is six. Coating is applied on the surface of each of the rotors 13, 14 for adjusting the clearance therebetween.

As shown in FIG. 1, the end cover 5 is fixed to the rotor housing 1 by means of a plurality of bolts 15 so as to cover the bearings 8A, 11A and the rotary shafts 9, 12 located on one side of the roots type compressor. The gear housing 3 is fixed to the end plate 2 having therein the bearings 8B, 11B by means of a plurality of bolts (not shown) so as to form a gear chamber 3A on the other side of the roots type compressor. The motor housing 4 is fixed to the gear housing 3 by means of a plurality of bolts (not shown) so as to form therein the motor chamber 4A.

The gear housing 3 has a hole 3B formed therethrough for communication with the gear chamber 3A. A shaft seal 16 is arranged in the hole 3B. The rotary shaft 12 extends from the rotor chamber 1A to the motor chamber 4A through the gear chamber 3A and the shaft seal 16 and is driven to rotate by a motor 17 disposed in the motor chamber 4A.

A drive gear 18 is fixed on the rotary shaft 12 in the gear chamber 3A. The rotary shaft 9 extends from the rotor chamber 1A to the gear chamber 3A. A driven gear 19 is fixed on the rotary shaft 9 in the gear chamber 3A. The drive gear 18 and the driven gear 19 are engaged with each other and cooperate to form a gear train for driving the rotors 13, 14. As shown in FIG. 2, a plurality of fluid chambers 20 are formed between the rotors 13, 14 and the inner surface of the rotor chamber 1A.

The following will describe the shape of the rotors 13, 14 in detail. The rotors 13, 14 are plane symmetrical to each other and, therefore, only one of the rotors, i.e. the rotor 13, will be described and the description of the rotor 13 is also applicable to the rotor 14.

The shape of the rotor 13 is defined by the axis O1 of the rotary shaft 9, a plurality of imaginary lines Li, curved outlines Le and outer surfaces F. The number n of the imaginary lines Li corresponds to the number of lobe portions 13A, i.e. six. The imaginary lines Li extend radially from the axis O1 toward the respective top end of the lobe portions 13A at an angularly spaced interval of 60 degrees. In other words, the lobe portions 13A are located on the imaginary lines Li, respectively. The outline Le extends from the apex end T of the lobe portion 13A to the bottom end B of the valley portion 13B through a first transition point C1 and a second transition point C2. The outer surface F is formed by the outline Le rotated and moved in the direction of the axis O1 (FIG. 1).

The outline Le of the rotor 13 is formed by an arc 21A, an involute curve 22A and an envelope curve 23. The arc 21A, which forms a part of a circle 21 having its center at Q1 located on the imaginary line Li and a radius R, extends from the apex end T of the outline Le to the first transition point C1 which is located between the arc 21A and the involute curve 22A. Reference symbol R1 indicates the distance from the axis O1 to the center Q1 of the circle 21. The involute curve 22A, which is formed by an imaginary base circle 22 having a center Q2 located at the axis O1 and a radius r, extends continuously from the first transition point C1 to the second transition point C2 which is located between the involute curve 22A and the envelope curve 23 and on the imaginary base circle 22. As shown in FIG. 2, the involute curve 22A is formed continuously with the arc 21A. The envelope curve 23 with an arc having a radius R extends from the second transition point C2 to the bottom end B of the outline Le and along outside of a path of the arc 21A of the lobe portion 14A of the mating rotor 14. The envelope curve 23 is formed continuously with the involute curve 22A.

The radius R of the circle 21 and the radius r of the imaginary base circle 22 which are used for drawing the arc 21A, the involute curve 22A and the envelope curve 23 are determined as follows.

Firstly, a line L3 that is tangential to the arc 21A of the mating rotor 14 is drawn from the axis O1, as shown in FIG. 2. The angle formed between the line L1 and the tangential line L3 is a degrees. The tangential line L3 contacts with the arc 21A at an intersection point P1. The center Q3 of the arc 21A of the mating rotor 14 is located at the midpoint of the distance L between the axis O1 of the rotary shaft 9 and the axis O2 of the rotary shaft 12. The tangential line L3 intersects perpendicularly with a straight line connecting the intersection point P1 and the center Q3.

Therefore, the following equation 1-1 is obtained.

$$R=L\sin\alpha/2 \quad 1\text{-}1$$

Then, the equation 1-1 is changed to the following equations 1-2 and 1-3.

$$\sin\alpha=R/L \quad 1\text{-}2$$

$$\cos\alpha=r/L \quad 1\text{-}3$$

Figure 3:
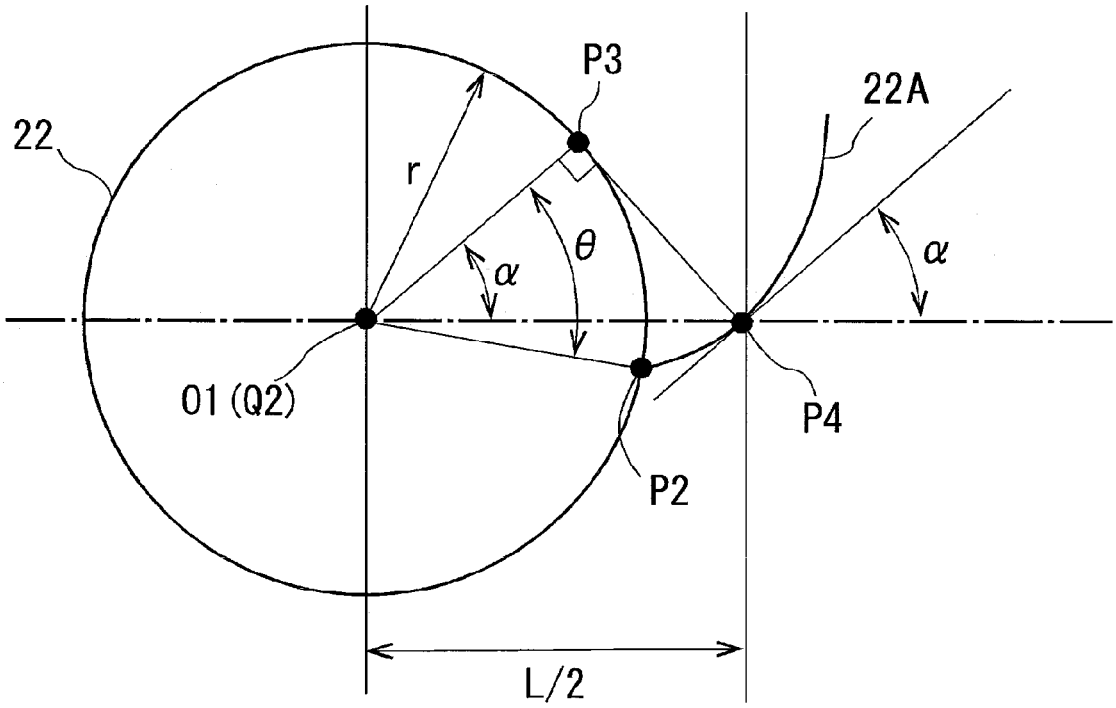
FIG. 3 is a diagram showing a relation between an involute curve and its base circle in the roots type compressor of FIG. 1.

As shown in FIG. 3, the involute curve 22A is drawn from a point P2 based on the imaginary base circle 22 having the radius r.

Therefore, the following equations 1-4 and 1-5 are obtained.

$$\tan\alpha=P4P3/O1Ps=r\theta/r=\theta \quad 1\text{-}4$$

$$\theta=\mathrm{inv}\alpha+ \quad 1\text{-}5$$

The following equation 1-6 is obtained from the equations 1-4 and 1-5.

$$\mathrm{inv}\alpha=\tan\alpha-\alpha \quad 1\text{-}6$$

In the case that the number of the lobe portions is n and the rotors are bilaterally symmetrical with each other, condition of continuity is expressed by the following equation 1-7.

$$\theta=2\pi/4n=\pi/2n \quad 1\text{-}7$$

Thus, the following equation 1-8 is obtained from the equations 1-4 and 1-7.

$$\theta=\tan\alpha=\pi/2n \quad 1\text{-}8$$

The following equation 1-9 is obtained from the equations 1-2, 1-3 and 1-8.

$$R=\pi r/2n \quad 1\text{-}9$$

The following equation 1-10 is obtained from the equation 1-9 and a equation $\sin^2\alpha+\cos^2\alpha=1$.

$$r=nL/(\pi^2+4n^2)^{1/2} \quad 1\text{-}10$$

Thus, the rotor 13 used in this preferred embodiment is formed such that the radius r of the imaginary base circle 22 is $nL/(\pi^2+4n^2)^{1/2}$ and the radius R of the circle 21 is $\pi r/2n$.

Figure 12A:
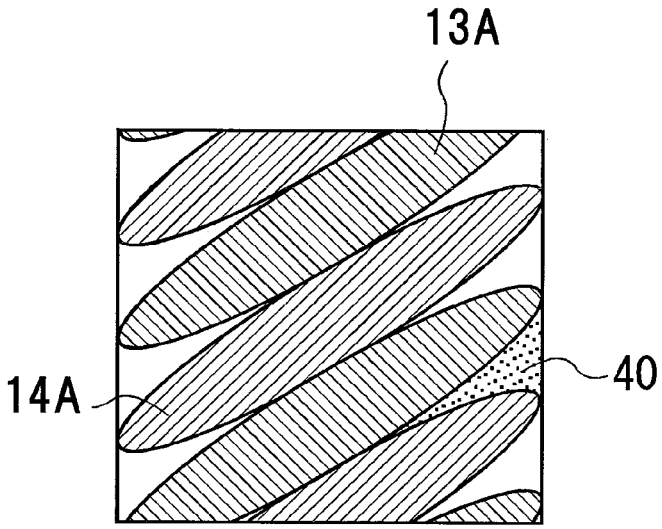
FIG. 12A is a longitudinal sectional view of the rotors disposed in the rotor chamber in the roots type compressor of FIG. 1.
Figure 12B:
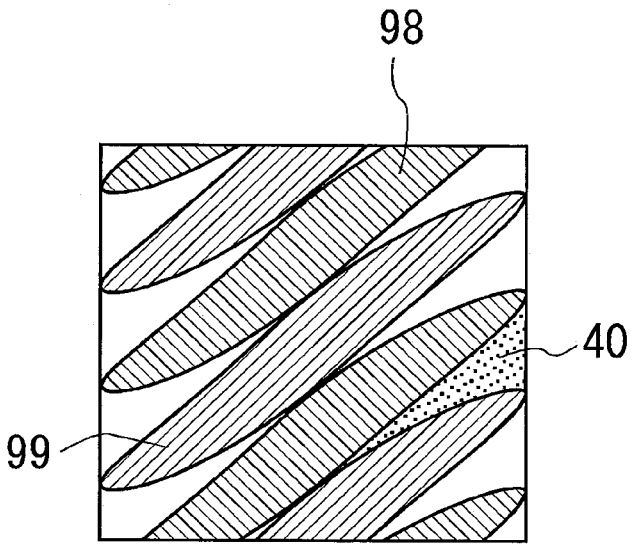
FIG. 12B is a longitudinal sectional view of the rotors disposed in the rotor chamber in a roots type compressor of a comparative example 3.

Therefore, in the case that the diameter meets the condition of $nL/(\pi^2+4n^2)^{1/2}<r<L/2$ and the radius R meets the condition $\pi r/2n<R$, the shape of the envelope curve 23 of the rotor 13 is substantially the same as that of the arc 21A of the rotor 14. In this case, the dead volume 30 shown in FIG. 13 disappears, so that power loss and noise development are further reduced in the roots type compressor. In this case, the shapes of the envelope curve 23 of the rotor 13 and the arc 21A of the rotor 14 become smoother as compared to the case that the radius r meets the condition $r<nL/(\pi^2+4n^2)^{1/2}$ and the radius R meets a condition $R<\pi r/2n$, with the result that power loss and the noise development caused by pulsation may be reduced. Furthermore, the backflow port 40 becomes smaller, as shown in FIG. 12A, thereby increasing the internal compression force.

On the other hand, in the case that the radius r meets a condition $r<nL/(\pi^2+4n^2)^{1/2}$ and the radius R meets a condition $R<\pi r/2n$, the dead volume 30 is increased, but the volumetric efficiency of the roots type compressor is improved and the roots type compressor becomes smaller in size as compared to the case that the radius r meets a condition $nL/(\pi^2+4n^2)^{1/2}<r<L/2$ and the radius R fleets a condition $\pi^2/2n<R$.

In the roots type compressor of the present embodiment, when the outer surface F of the rotor 13 is defined by the outline Le rotated and moved in the direction of the axis O1, a torsional angle β is set larger than 60 degrees, which will be described as follows.

Figure 4:
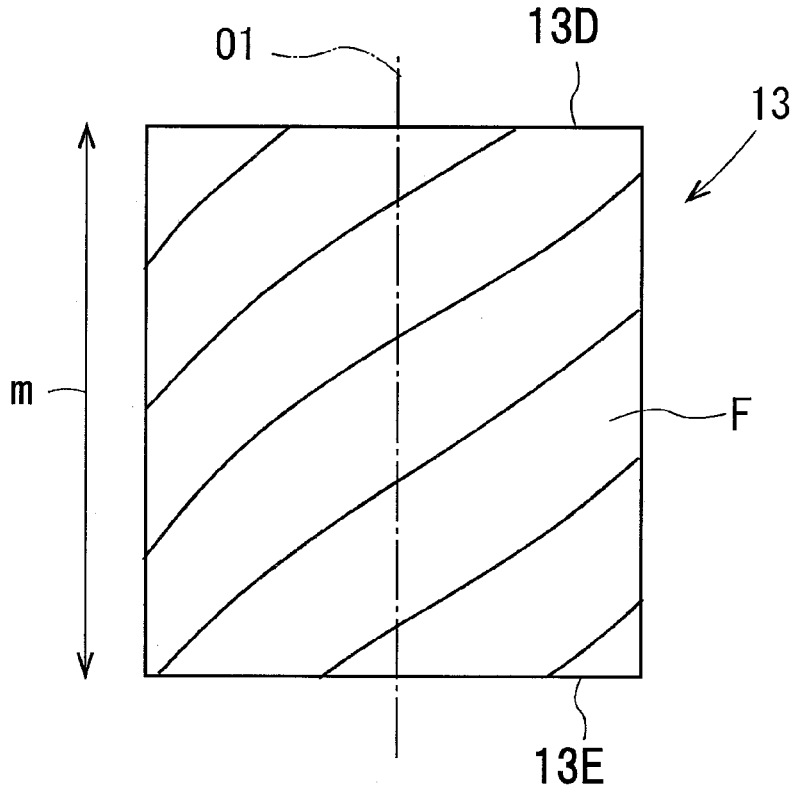
FIG. 4 is a side view of one of the rotors of the roots type compressor of FIG. 1.
Figure 5:
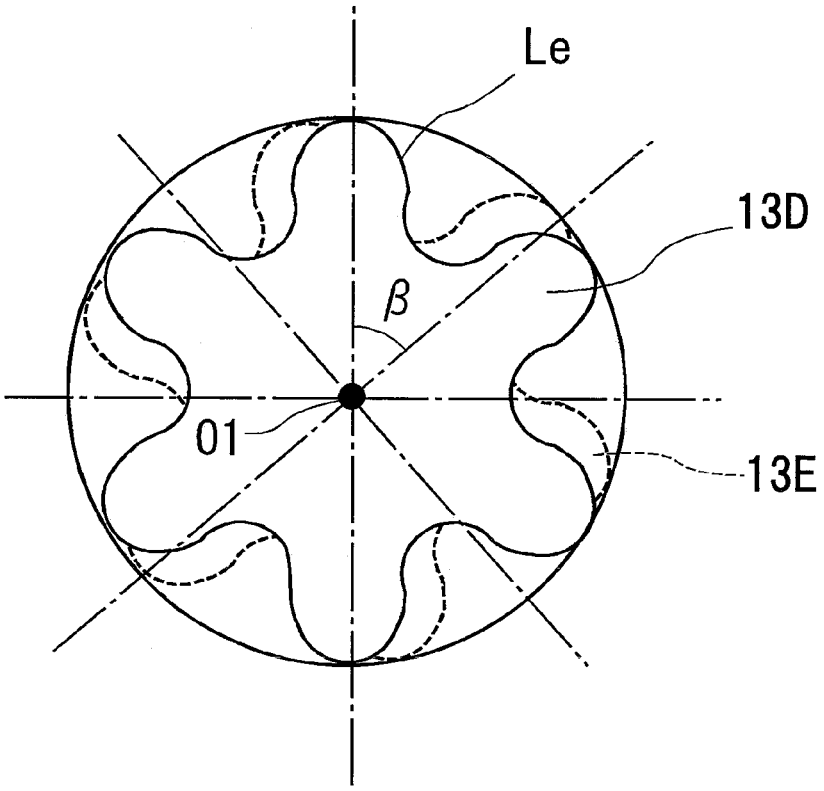
FIG. 5 is a schematic view showing the front and rear end surfaces of one of the rotors of the roots type compressor of FIG. 1.
Figure 6:
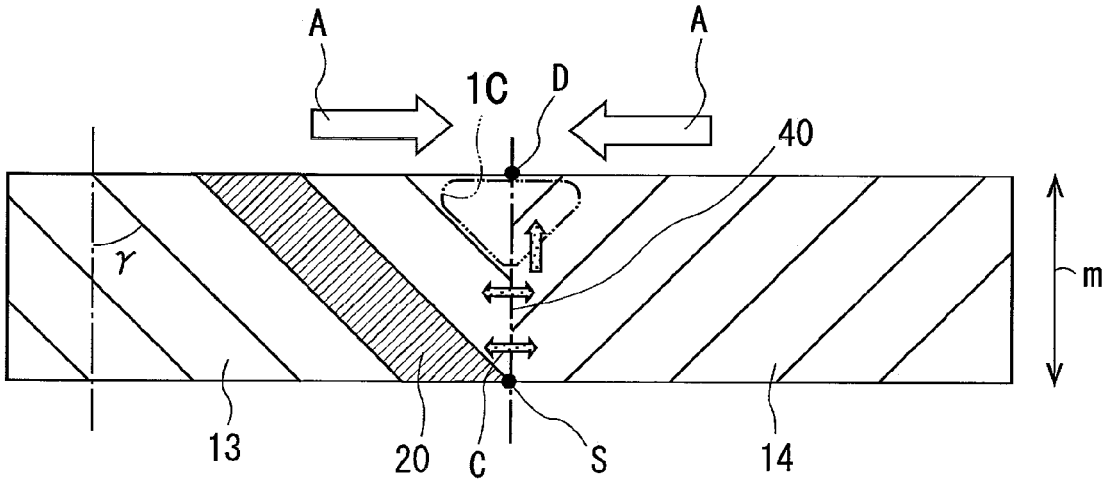
FIG. 6 is an expansion plan view of the rotors disposed in a rotor chamber of the roots type compressor of FIG. 1.
Figure 7:
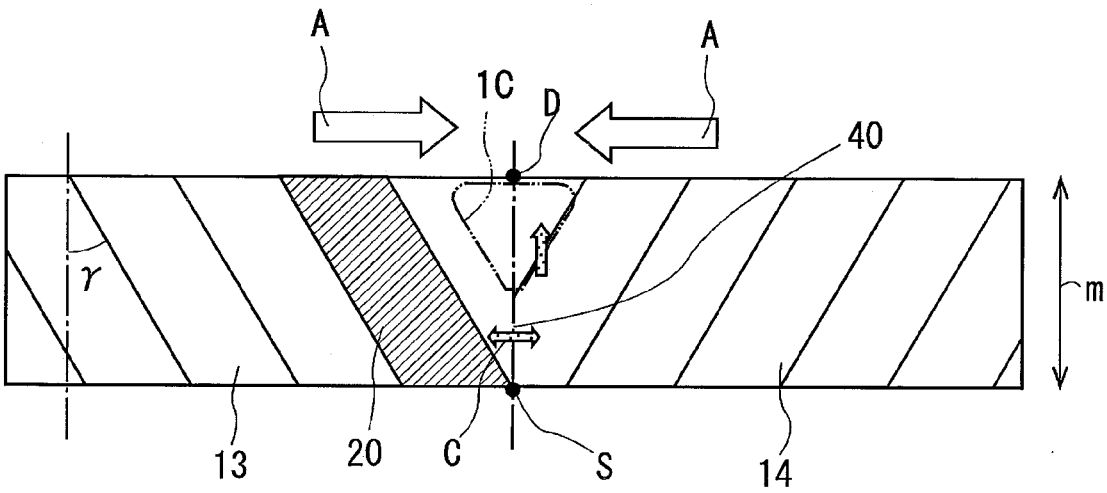
FIG. 7 is an expansion plan view of a pair of rotors disposed in a rotor chamber of a roots type compressor of a comparative example 1.
Figure 8:
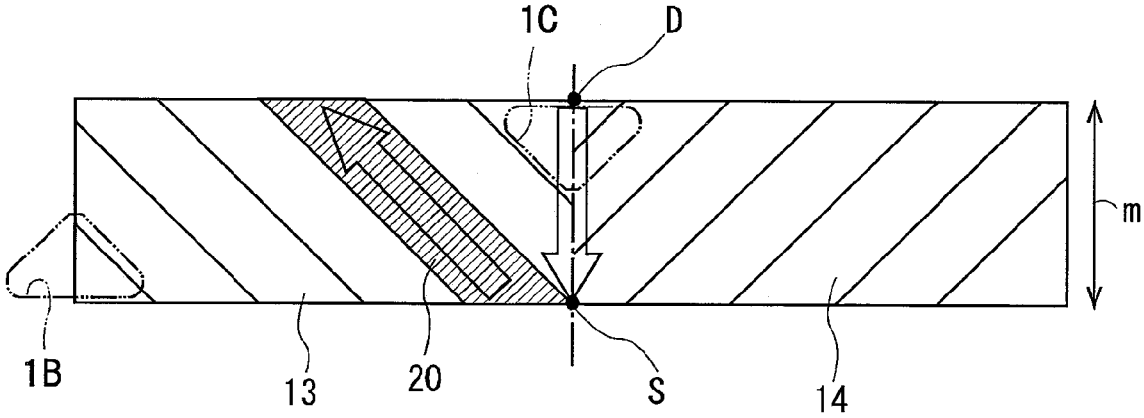
FIG. 8 is an expansion plan view of a pair of the rotors disposed in the rotor chamber of the roots type compressor of FIG. 1.
Figure 9:
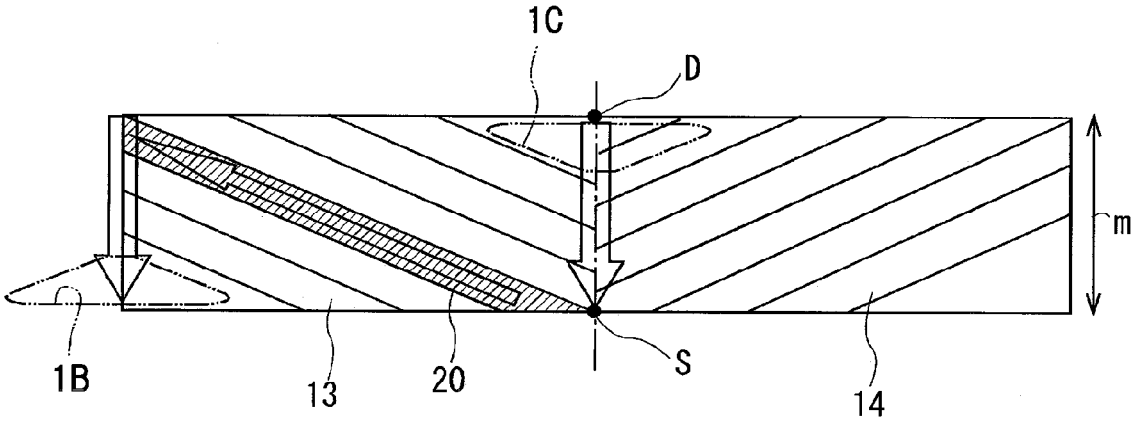
FIG. 9 is an expansion plan view of a pair of rotors disposed in a rotor chamber of a roots type compressor of a comparative example 2.
Figure 10:
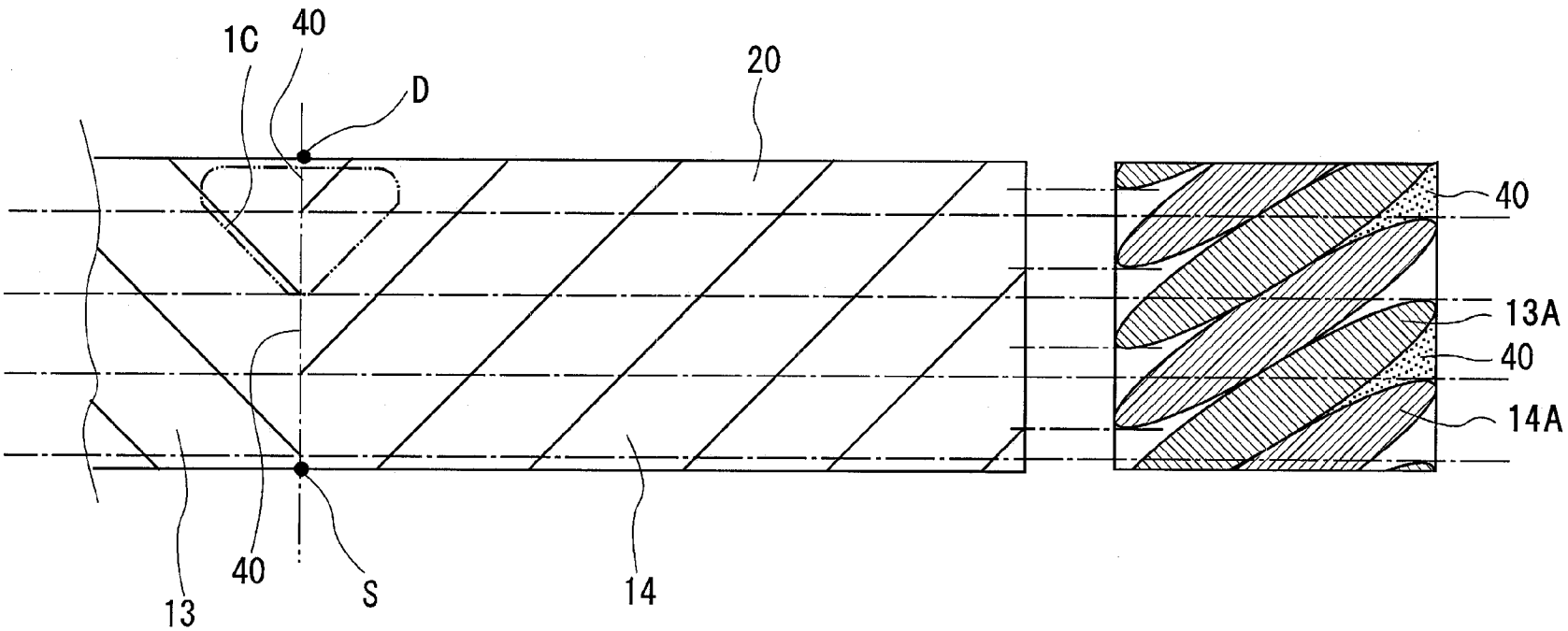
FIG. 10 is a schematic view showing a positional relation between the expansion plan view of the rotors disposed in the rotor chamber and the sectional view of the rotor in the roots type compressor of FIG. 1.

When defining the outer surface F of the rotor 13 by the outline Le rotated and moved in the direction of the axis O1 for an axial distance m, as shown in FIGS. 4, 5, the rotor 13 is formed such that the rear end surface 13E of the rotor 13 is rotated for the torsional angle β with respect to the front end surface 13D, as shown in FIGS. 4, 5. The torsional angle β is an angle generated by rotating the outline Le around the axis O1 while the outline Le is moved in the axial distance m. FIG. 4 is a side view of the rotor 13, and FIGS. 6 through 9 are expansion plan views of the outer surfaces of the rotors 13, 14. FIGS. 6, 8 are expansion plan views in the case when the torsional angle β is 120 degrees in the preferred embodiment, FIG. 7 is an expansion plan view in the case when the torsional angle β is 60 degrees as a comparative example 1, and FIG. 9 is an expansion plan view in the case when the torsional angle β is 200 degrees as a comparative example 2. Since the rotors 13, 14 are uniformly twisted about the axis O1, the lobe portions 13A, 14A of the rotors 13, 14 are represented by straight lines in the expansion plan views of FIGS. 6 through 9. The angle γ formed between the straight line of the lobe portion 13A and a dashed-line shown in the expansion plan views of FIGS. 6, 7 is a helix angle of the lobe portions 13A, 14A. In the case when the torsional angle β is 120 degrees, the fluid chambers 20 of the rotors 13, 14 are closed from the discharge port 1C and the suction port 1B, as shown in FIG. 8, so that pumping operation is performed in the fluid chambers 20. In the case when the torsional angle β is more than 200 degrees, the fluid chambers 20 of the rotors 13, 14 communicate with the discharge port 1C and the suction port 1B through the backflow port 40 (FIG. 12A), as shown in FIG. 9, so that no pumping is performed. FIG. 10 shows positional relation between an expansion plan view of the rotors 13, 14 in which the torsional angle β is 120 degrees and longitudinal cross-sectional views of the rotors 13, 14. As shown in FIG. 10, the fluid chambers 20 of the rotors 13, 14 communicate with each other through the backflow port 40.

Figure 11:
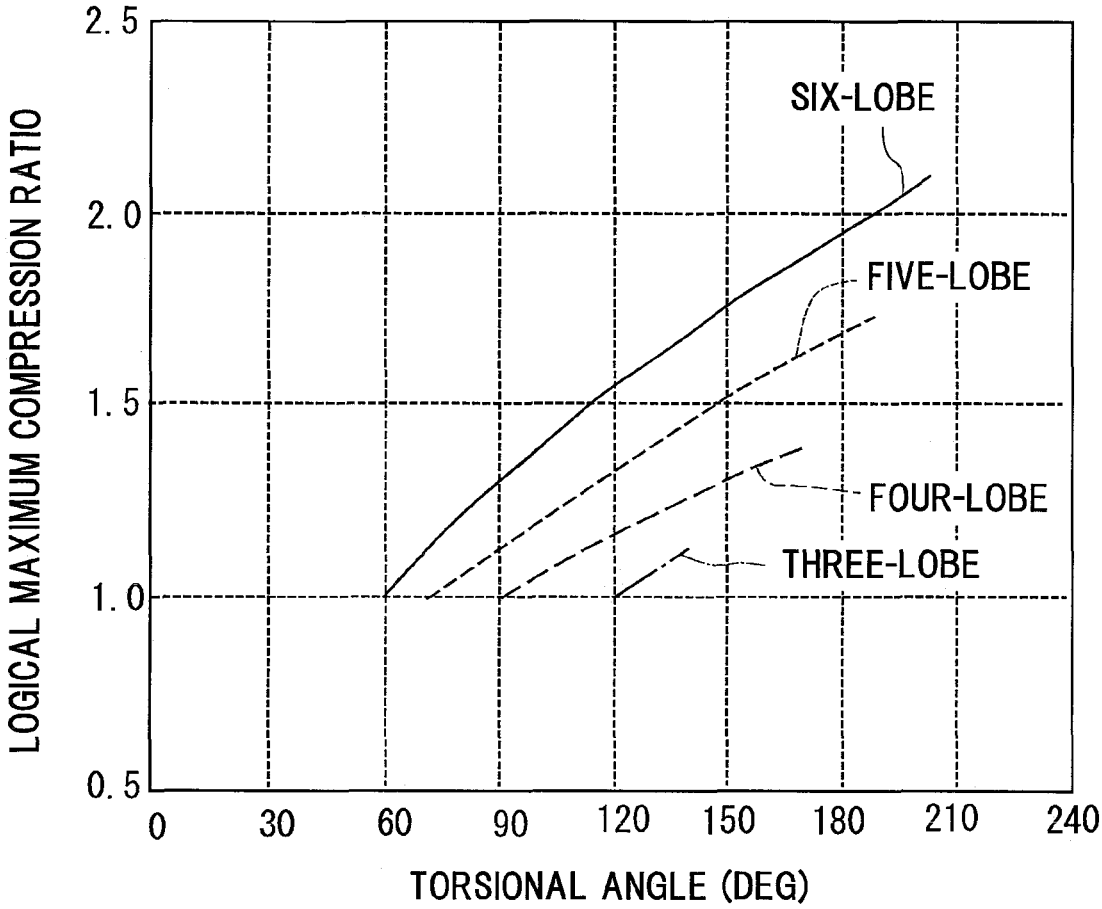
FIG. 11 is a graph showing the relation between a torsional angle and a logical maximum compression ratio in a roots type compressor.

Referring to FIG. 11, in the present embodiment of the roots type compressor using six-lobe rotors 13, 14, the theoretical compression ratio becomes over 1.0 if the torsional angle β is set over 60 degrees. Theoretically, the maximum torsional angle β max with which maximum compression ratio is achievable is 200 degrees because x=50 and n=6 in the equation 2 below. If the torsional angle β is 200 degrees, the compression ratio becomes over 2.0.

The following equation 2 is obtained from the equations 1-2, 1-3 and 1-8.

$$\beta=360-2x-360/n \qquad 2$$

If the rotors are of three-lobe configuration (n=3), the compression ratio does not exceed 1.0 unless the torsional angle β is over 120 degrees. The maximum torsional angle) β max in the case of rotors of three-lobe configuration is 140 degrees because x=50 and n=3 in the above equation 2. If the torsional angle β is 140 degrees, the compression ratio is approximately 1.0 and it is difficult to form the suction port 1B and the discharge port 1C appropriately in the rotor housing 1. Additionally, if the torsional angle β is over 140 degrees, the suction port 1B and the discharge port 1C communicate with each other through the backflow port 40 and the fluid chambers 20, so that overall thermal efficiency ηtad is not sufficiently improved.

Meanwhile, in the case when the rotors of four-lobe configuration (n=4), the compression ratio will not exceed 1.0 unless the torsional angle β is over 90 degrees. Because x=50 and n=4 in the above equation 2, the torsional angle β is 170 degrees. If the torsional angle β is 170 degrees, the compression ratio is approximately 1.4 and the suction port 1B and the discharge port 1C may be formed appropriately in the rotor housing 1.

If the rotors of five-lobe configuration (n=5), the compression ratio will not exceed 1.0 unless the torsional angle β is over 75 degrees. Because x=50 and n=5 in the above equation 2, the maximum torsional angle β max is 188 degrees. If the torsional angle β is 188 degrees, the compression ratio is approximately 1.7 and the suction port 1B and the discharge port 1C may be formed easily in the rotor housing 1.

In the roots type compressor constructed as described above, when the motor 17 drives the rotary shaft 12 to rotate, the engagement of the drive gear 18 and the driven gear 19 causes the rotary shaft 9 to rotate. Thus, the rotors 13, 14 engaged with each other are rotated in the rotor chamber 1A. During the rotation of the rotors 13, 14, the fluid chamber 20 firstly communicates with the suction port 1B, then closed from the suction port 1B and the discharge port 1C, and finally communicates with the discharge port 1C. The volume of the fluid chamber 20 is gradually increased while the fluid chamber 20 is in communication with the suction port 1B, and gradually decreased while the fluid chamber 20 is closed and in communication with the discharge port 1C, thereby performing pumping operation. In the roots type compressor, fluid flowed in through the suction port 1B in to the fluid chamber 20 is compressed and then discharged out through the discharge port 1C.

During the operation of the roots type compressor according to the preferred embodiment of the present invention, the fluid chambers 20 formed between the any two adjacent lobe portions 13A, which are shown in FIG. 2, are moved in the directions of arrows A shown in FIG. 6. The area of the discharge port 1C is adjusted such that the pressure in the discharge port 1C is substantially the same as the pressure in the fluid delivering system of the present invention. If the pressure in the discharge port 1C is lower than pressure in the fluid delivering system, pressure loss is generated in the roots type compressor, and if larger, it becomes difficult to compress fluid. Thus, irrespective of the value of n or the structure of the roots type compressor, the area of the discharge port 1C is substantially unchanged. The shape of the discharge port 1C should be formed such that the angle between the edge and the axis thereof is substantially the same as the helix angle γ. By so doing, the fluid chamber 20 remains closed from the discharge port 1C to the limit and fluid is further compressed, accordingly.

Figure 13:
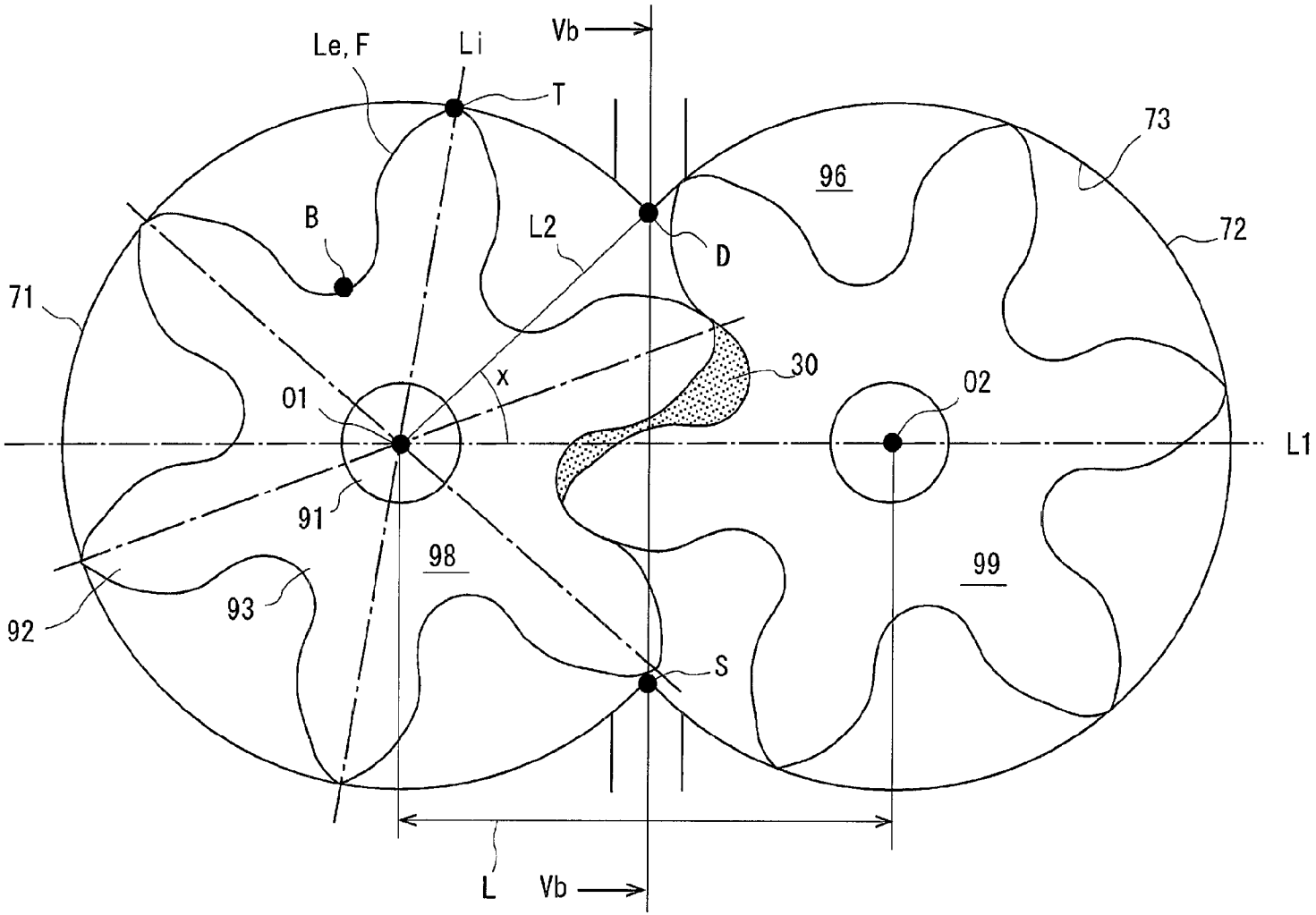
FIG. 13 is a schematic view showing in cross section a housing and rotors of a roots type compressor of a background art or the comparative example 3.
Figure 14:
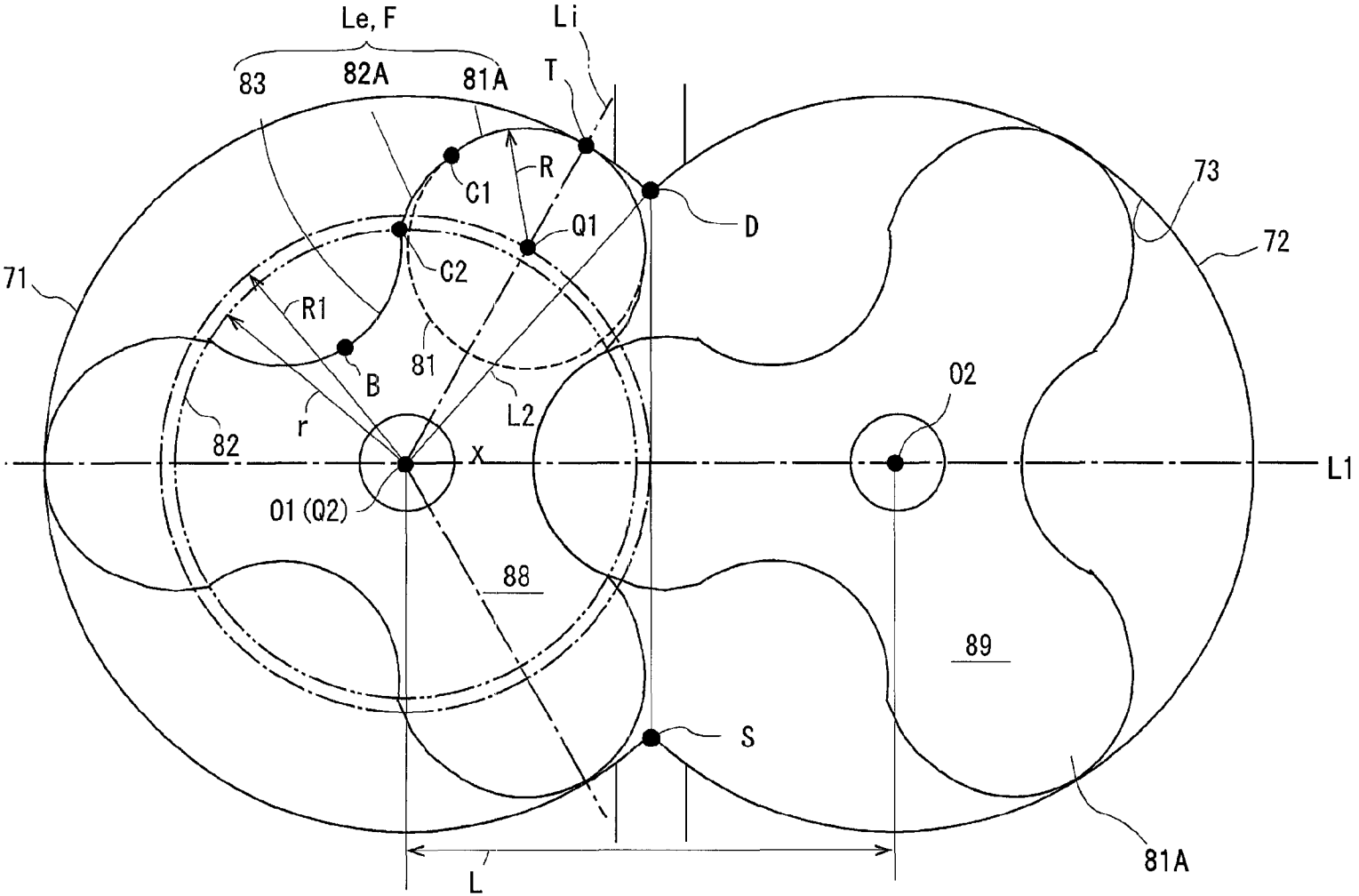
FIG. 14 is a schematic view showing in cross section a housing and rotors of a roots type compressor of another background art.

In addition, the dead volume 30 shown in FIG. 13 formed between the rotors 13, 14 is made to disappear, or smaller. When the fluid chamber 20 reaches the cusp S, the fluid chamber 20 begins to communicate with its mating fluid chamber 20 through the backflow port 40, as shown by an arrow C in FIG. 6, and simultaneously the volume of the fluid chamber 20 begins to be decreased thereby to start fluid compression. This fluid compression is performed until the fluid chamber 20 begins to communicate with the discharge port 1C.

Meanwhile, in the conventional roots type compressor of FIG. 13 in which the outlines Le of the rotors 98, 99 are formed by an involute curve and an envelope curve, the dead volume 30 formed between the rotors 98, 99 is relatively large. In the roots type compressor according to the preferred embodiment of the present invention, fluid hardly leaks out, so that pressure loss hardly occurs. In addition, fluid reexpansion hardly occurs, thereby preventing generation of noise.

In the roots type compressor according to the preferred embodiment of the present invention, where a part of the outline Le extending from the second transition point C2 to the bottom end B is formed by the envelope curve 23, as shown in FIG. 2, the appropriate clearance may be kept between the rotors 13, 14. Therefore, if a backlash or a phase shift occurs between the drive gear 18 and the driven gear 19 during assembling or operation, coating on the surfaces of the rotors 13, 14 is hardly peeled off and stable volumetric efficiency ηV is achieved.

In the roots type compressor of the preferred embodiment, the torsional angle β may be set in the range between 60 and 200 degrees. Thus, fluid is compressed by the outer surface F in the fluid chamber 20 with a relatively large compression force. The section of the rotors 13, 14 overlapped with each other is shown in FIG. 12A. As apparent from FIG. 12A, the backflow port 40 is relatively formed small in size.

Meanwhile, in the roots type compressor according to a comparative example 3 of FIG. 13 in which the outlines Le of the rotors 98, 99 are formed by an involute curve and an envelope curve, the backflow port 40 is relatively formed large in size as shown in 12B. In the roots type compressor according to this preferred embodiment of the present invention having small-sized backflow port 40, however, the fluid chamber 20 remains closed from the discharge port 1C to the limit, thereby improving the overall thermal efficiency ηtad of the compressor.

Therefore, in the roots type compressor according to the preferred embodiment of the present invention, power loss and noise development may be reduced and stabilized volume efficiency and reliable and excellent overall thermal efficiency ηtad may be achieved.

The present invention is not limited to the above-described preferred embodiment, but it may be modified in various ways as exemplified below. The roots type fluid machine according to the preferred embodiment of the present invention may be embodied into not only a roots type compressor but also a roots type pump or roots type blower.

The present invention may be applied to an air conditioner, a turbo charger or a fuel cell system.

What is claimed:

1. A roots type fluid machine comprising:

a housing;

a rotor chamber formed by the housing;

a suction port formed in the housing;

a discharge port formed in the housing;

a pair of rotary shafts rotatably arranged in parallel to each other in the rotor chamber;

a pair of rotors, plane symmetrical to each other, each rotor being fixed on one of the rotary shafts for rotation therewith in the rotor chamber and respectively having a number n of lobe portions with an apex end and valley portions with a bottom end for engaging each other, wherein the lobe portions of each rotor are located on imaginary lines extending radially from an axis of the associated rotary shaft at an angular spacing apart respectively, a fluid chamber defined by the outer surfaces of the rotors and the inner surface of the rotor chamber, and in which fluid is caused to flow in through the suction port and discharged out through the discharge port by rotating the rotors, wherein the outer surface of each one of the rotors is generated by rotating an outline of the rotor around and moving the outline in the direction of the axis of the associated rotary shaft, the outline of the rotor extending from each apex end of the lobe portion to the bottom end of the valley portion through a first transition point and a second transition point thereon, the outline of the rotor including an arc extending from the apex end of the lobe portion to the first transition point and having a radius R and a center located on the imaginary line, an involute curve extending continuously from the first transition point to the second transition point and formed by an imaginary base circle having a radius r and a center located on the axis of the rotary shaft, and an envelope curve with an arc having a radius R extending continuously from the second transition point to the bottom end of the valley portion, wherein the number n of the lobe portions is four or more, and a torsional angle β of the lobe portions is over 360/n degrees, and wherein the axes of the rotary shafts are spaced away from each other at a distance L, and the diameter r of the circle meets a condition of $r<nL/(\pi^2+4n^2)^{1/2}$ and the radius R of the arc meets the condition $R<\pi r/2n$.

2. A roots type fluid machine comprising:

a housing;

a rotor chamber formed by the housing;

a suction port formed in the housing;

a discharge port formed in the housing;

a pair of rotary shafts rotatably arranged in parallel to each other in the rotor chamber;

a pair of rotors, plane symmetrical to each other, each rotor being fixed on one of the rotary shafts for rotation therewith in the rotor chamber and respectively having a number n of lobe portions with an apex end and valley portions with a bottom end for engaging each other, wherein the lobe portions of each rotor are located on imaginary lines extending radially from an axis of the associated rotary shaft at an angular spacing apart respectively, a fluid chamber defined by the outer surfaces of the rotors and the inner surface of the rotor chamber, and in which fluid is caused to flow in through the suction port and discharged out through the discharge port by rotating the rotors, wherein the outer surface of each one of the rotors is generated by rotating an outline of the rotor around and moving the outline in the direction of the axis of the associated rotary shaft, the outline of the rotor extending from each apex end of the lobe portion to the bottom end of the valley portion through a first transition point and a second transition point thereon, the outline of the rotor including an arc extending from the apex end of the lobe portion to the first transition point and having a radius R and a center located on the imaginary line, an involute curve extending continuously from the first transition point to the second transition point and formed by an imaginary base circle having a radius r and a center located on the axis of the rotary shaft, and an envelope curve with an arc having a radius R extending continuously from the second transition point to the bottom end of the valley portion, wherein the number n of the lobe portions is four or more, and a torsional angle β of the lobe portions is over 360/n degrees, and wherein the axes of the rotary shafts are spaced away from each other at a distance L, and the diameter r of the circle meets a condition of $nL/(\pi^2+4n^2)^{1/2}$ and the radius R of the arc meets the condition $\pi r/2n<R$.

3. The roots type fluid machine according to claim 1, wherein the second transition point is on the imaginary base circle.

4. The roots type fluid machine according to claim 1, wherein the number n of the lobe portions is six, and wherein the torsional angle β is in a range between 60 and 200 degrees.

5. The roots type fluid machine according to claim 1, wherein the rear end surface of the rotor is rotated for the torsional angle β with respect to a front end surface of the rotor.

* * * * *